US010900734B2

(12) United States Patent
Hailey et al.

(10) Patent No.: US 10,900,734 B2
(45) Date of Patent: Jan. 26, 2021

(54) FIREARM SUPPRESSOR

(71) Applicant: Hailey Ordnance Company, Oklahoma City, OK (US)

(72) Inventors: Stephen C. Hailey, Edmond, OK (US); John Matthew Wilkes, Oklahoma City, OK (US)

(73) Assignee: Hailey Ordnance Company, Oklahoma City, OK (US)

( * ) Notice: Subject to any disclaimer, the term of this patent is extended or adjusted under 35 U.S.C. 154(b) by 0 days.

(21) Appl. No.: 16/421,137

(22) Filed: May 23, 2019

(65) Prior Publication Data

US 2020/0025497 A1 Jan. 23, 2020

Related U.S. Application Data

(63) Continuation of application No. 15/336,223, filed on Oct. 27, 2016, now Pat. No. 10,345,069.

(60) Provisional application No. 62/247,132, filed on Oct. 27, 2015.

(51) Int. Cl.
*F41A 21/30* (2006.01)
*F41A 21/28* (2006.01)

(52) U.S. Cl.
CPC ..... *F41A 21/30* (2013.01); *F41A 21/28* (2013.01)

(58) Field of Classification Search
CPC ..... F41A 21/30; F41A 21/28
USPC ..... 89/14.05, 14.1, 14.2, 14.3; 181/223; 42/76.01
See application file for complete search history.

(56) References Cited

U.S. PATENT DOCUMENTS

| | | | | | |
|---|---|---|---|---|---|
| 3,380,344 | A * | 4/1968 | Bucklisch | F41A 1/06 | 89/14.3 |
| 4,384,507 | A * | 5/1983 | Finn | F41A 21/30 | 181/241 |
| 4,501,189 | A * | 2/1985 | Brandl | F41A 21/30 | 89/14.4 |
| 4,974,489 | A * | 12/1990 | Fishbaugh | F41A 21/30 | 89/14.4 |
| 5,992,291 | A * | 11/1999 | Widder | F41A 21/28 | 102/520 |
| 6,575,074 | B1 * | 6/2003 | Gaddini | F41A 21/30 | 89/14.4 |
| 7,789,008 | B2 * | 9/2010 | Petersen | F41A 21/30 | 89/14.4 |
| 7,832,323 | B1 * | 11/2010 | Davies | F41A 21/325 | 89/14.4 |
| 8,286,750 | B1 * | 10/2012 | Oliver | F41A 21/30 | 181/223 |
| 8,511,425 | B2 * | 8/2013 | Larue | F41A 21/30 | 181/223 |
| 9,273,920 | B2 * | 3/2016 | Clarke | F41A 21/28 | |
| 9,291,417 | B2 * | 3/2016 | James | F41A 21/30 | |
| 9,500,423 | B2 * | 11/2016 | Wilkinson | F41A 5/28 | |
| 9,921,022 | B1 * | 3/2018 | Noyce Merino | F41A 21/36 | |
| 9,982,959 | B2 * | 5/2018 | Washburn, III | F41A 21/30 | |
| 10,126,084 | B1 * | 11/2018 | Oglesby | F41A 21/30 | |
| 2010/0180759 | A1 * | 7/2010 | Petersen | F41A 21/30 | 89/14.4 |

(Continued)

*Primary Examiner* — John Cooper
(74) *Attorney, Agent, or Firm* — McAfee & Taft

(57) ABSTRACT

A firearm suppressor comprises a barrel section with a vent therethrough and a baffle section extending from the barrel section comprising a plurality of baffles with barrel hole openings. At least a portion of the baffles are removable and replaceable.

4 Claims, 9 Drawing Sheets

(56) References Cited

U.S. PATENT DOCUMENTS

| | | | | |
|---|---|---|---|---|
| 2013/0168181 | A1* | 7/2013 | Wirth | F41A 21/30<br>181/223 |
| 2014/0157640 | A1* | 6/2014 | Whelan | F41A 21/30<br>42/75.02 |
| 2015/0001002 | A1* | 1/2015 | Wirth | F41A 21/30<br>181/223 |
| 2015/0090105 | A1* | 4/2015 | Pace | F41A 21/30<br>89/14.4 |
| 2015/0260473 | A1* | 9/2015 | Barney | F41A 21/30<br>89/14.4 |
| 2016/0003570 | A1* | 1/2016 | Tonkin | F41A 21/04<br>89/14.4 |
| 2016/0010935 | A1* | 1/2016 | Clarke | F41A 21/34<br>89/14.4 |
| 2017/0191779 | A1* | 7/2017 | Myers | F41A 21/30 |

* cited by examiner

FIREARM SUPPRESSOR

BACKGROUND

There are a number of firearm suppressors known in the art. Firearm suppressors generally are utilized to suppress the sound that occurs when a projectile is fired through the firearm to which the suppressor is attached. Integral suppressors are one type known in the art. Generally in an integral suppressor baffles are machined into or attached to an existing barrel. A suppressor sleeve will cover the baffles and in some cases all or part of the barrel. Integral suppressors generally include a port in the section of the barrel that is covered by the suppressor sleeve. The vent or port allows gas to vent in an annular chamber created by the suppressor sleeve and a section of the barrel while the projectile is in the barrel. The venting of the gas at this stage decreases the muzzle velocity of the projectile and reduces the sound level or decibel level of the shot.

Depending upon the type of ammunition used, a vent may or may not be desirable. For example, subsonic ammunition may lose additional velocity and impact force if shot through a suppressor with an open vent. For this reason, subsonic ammo is preferably shot in a barrel without a vent to maintain maximum velocity. Bulk ammunition and high velocity rounds can have velocity slowed to subsonic when used with an integral suppressor with an appropriately sized open vent. At times, however, it may be desirable to suppress sound but to not lose velocity and to maintain impact force even with standard and high velocity rounds, but especially with low velocity subsonic rounds where the additional loss of velocity is greatly increased by having an unrestricted port that allows excess gas to escape from the barrel into the suppressor.

SUMMARY

The current disclosure is directed to firearm suppressors or silencers. The firearm suppressor disclosed herein is an integral suppressor, which may also be referred to as a suppressed barrel. The integral suppressor disclosed herein has a barrel or barrel section with a vent or port therein. The embodiment described and shown herein has a single port, but it is understood that multiple ports of varying size could be utilized to control and/or vary the amount of gas flow therethrough. A metering device is included. The metering device is movable and may be positioned to cover or uncover the vent. The metering device is rotatable and will move from the open position in which gas is allowed to escape from the barrel section through the vent to a closed position in which the vent is closed. Thus, the integral suppressor is convertible from an integral suppressor with an open gas vent to a closed position in which the vent is closed. Thus, the integral suppressor described herein allows the user to trade velocity for sound reduction; or vice-versa.

The firearm suppressor disclosed herein thus includes a barrel section that defines a vent therethrough and a baffle section that extends from the barrel section. The metering device is rotatable about the barrel section. The metering device is configured to control the flow of gas through the vent upon firing of the projectile through the barrel section and the baffle section. A suppressor sleeve is disposed about the baffle section and the barrel section. Rotation of the suppressor sleeve will rotate the metering device. Rotation of the metering device will close and open the vent to prevent or to allow gas to flow through the vent respectively upon firing of a projectile through the barrel section.

The suppressor sleeve and barrel section define an annulus therebetween. In the open position gas is communicated through the metering device into the annulus from the barrel opening through which a projectile is fired. The gas will pass through the vent, through the metering device and into the annulus. In the embodiment disclosed, the metering device has grooves defined in an inner surface thereof. When the metering device is in the open position the vent is open and gas will pass through the vent into the grooves which will communicate the gas into the annulus.

The baffle section includes a plurality of primary baffles. The primary baffles are parallel baffles. In the current disclosure, there is also at least one and can be a plurality of intermediate baffles that are not parallel to the primary baffle. When more than one intermediate baffle is included, the intermediate baffles are likewise parallel to one another.

The barrel suppressor is convertible from a suppressor with an open vent which allows gas to escape the barrel opening through which the projectile is fired to a closed vent in which no gas escapes therethrough. The suppressor is convertible without the need for disassembly. An end cap will be connected to the end of the baffle section. The end cap is configured so that it may be loosened to allow rotation of the suppressor sleeve which will rotate the metering device between its open and closed positions in which the vent is either open or closed. In the current disclosure, the end cap is threadedly connected to the end of the baffle section. Thus, rotation of the suppressor sleeve may be achieved simply by loosening the end cap, and rotating the suppressor sleeve so that the metering device is moved to the desired open or closed position. While open and closed positions are discussed, it is understood that the metering device and suppressor sleeve can be configured such that the vent is fully open, fully closed or partially open to allow a desired amount of gas to escape therethrough.

Suppression without an open vent will still occur as the projectile passes through the baffle section. In that case, gas can pass from the baffle section through a helical groove into the annulus defined between the suppressor sleeve and the barrel section. The baffle configuration will create additional sound suppression.

BRIEF DESCRIPTION OF THE DRAWINGS

FIG. 6 is an end view of a metering device.

FIGS. 7 and 8 are images of the metering device and a portion of the barrel section.

FIG. 9 is an end view of the suppressor sleeve.

DESCRIPTION OF AN EMBODIMENT

Figure 1:
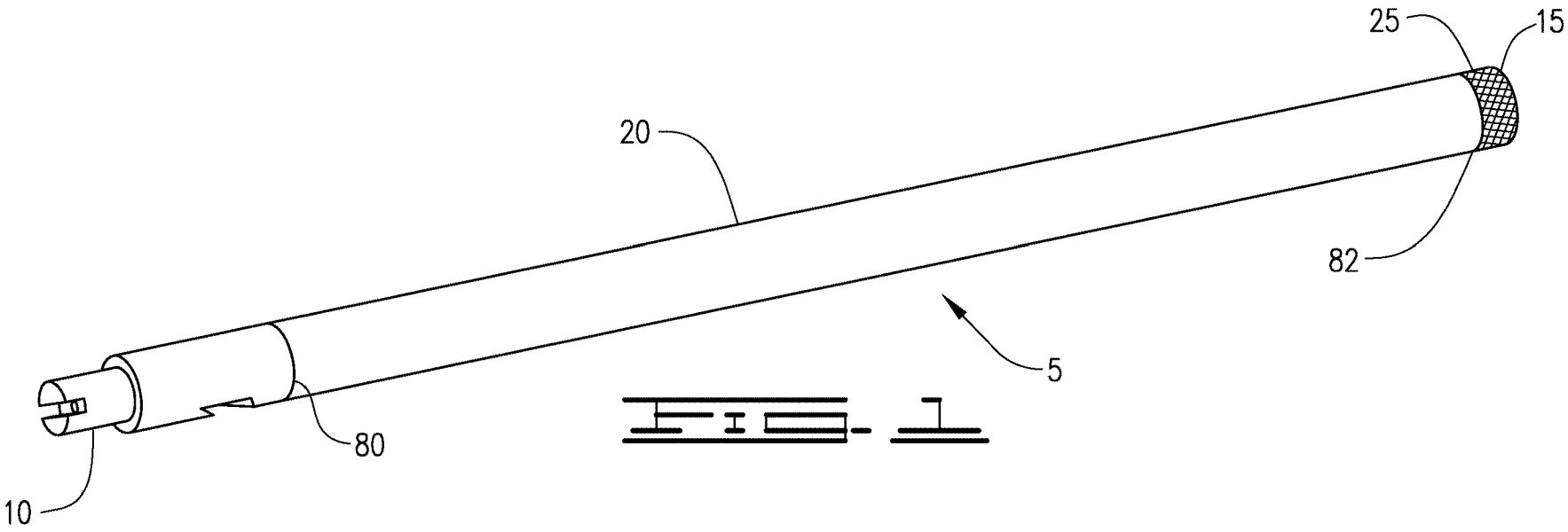
FIG. 1 is a perspective of an integral suppressor of the current disclosure.

A barrel suppressor or integral suppressor 5 for a firearm has a connecting end 10 and a discharge end 15. Integral suppressor 5 will connect to a firearm, and in the embodiment described will connect to a rifle at the connecting end 10 thereof in a manner known in the art. Integral suppressor 5 includes an outer or suppressor sleeve 20 with inner surface 21 and an end cap 25 which as explained in detail herein may be threaded to hold the suppressor sleeve 20 in place.

Figure 2:
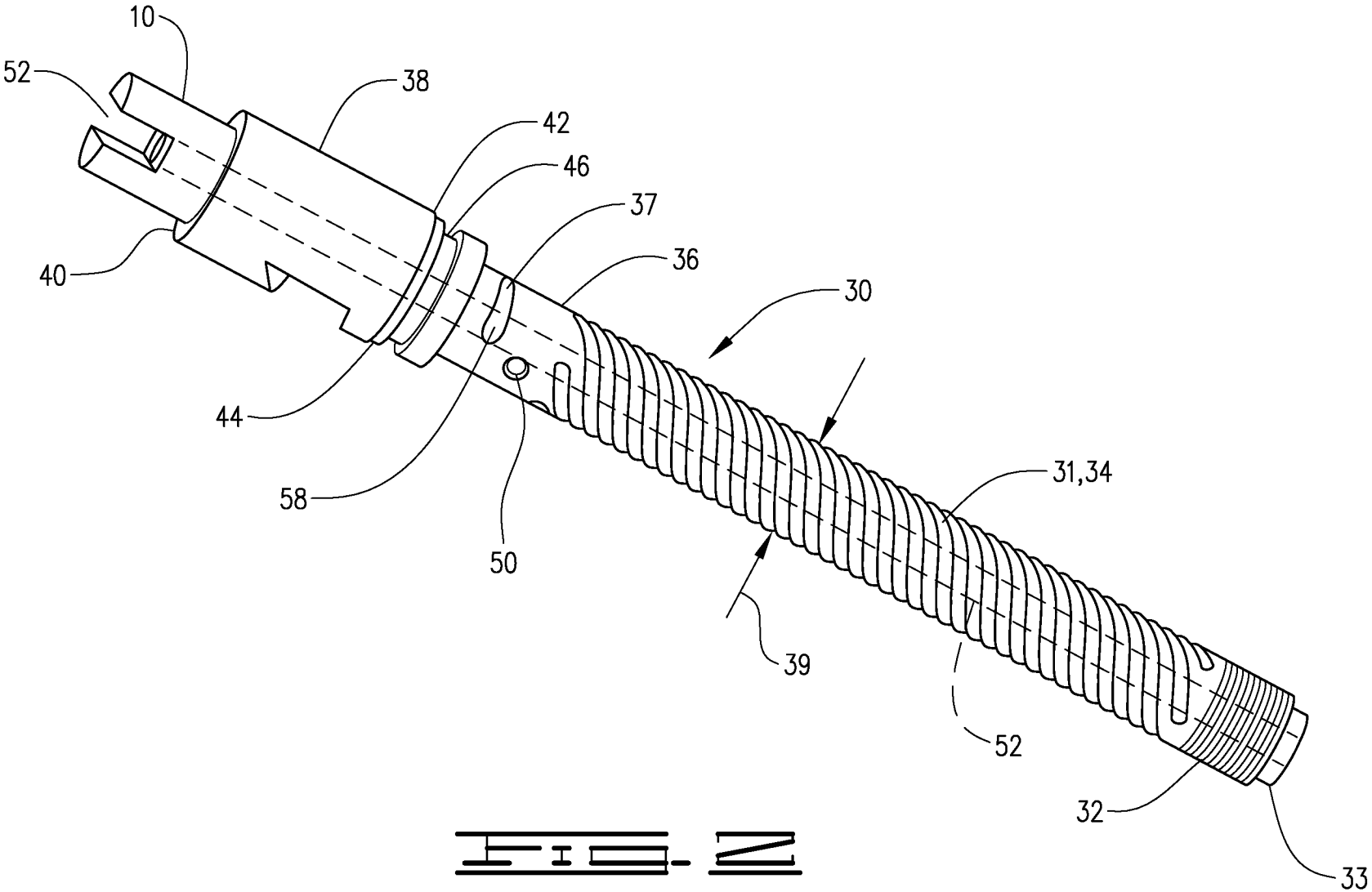
FIG. 2 is a view of the barrel section of the suppressor of the current disclosure.

Referring now to FIG. 2, the barrel section 30 of the integral suppressor 5 is shown. The barrel section 30 connects at connecting end 10 to the firearm in a manner known in the art and has threads 32 at a forward or discharge end 33 thereof. Barrel section 30 has flutes 34 machined therein in a fluted portion 31. The barrel section 30 has a non-fluted portion 36 rearward of the flutes 34. Non-fluted portion 36 has a slot 37 which may be referred to as a peripheral slot 37 that extends around a portion of the circumference of non-fluted portion 36 of barrel section 30. Barrel section 30 has a diameter 39.

A spacer portion 38 which may be referred to as an enlarged diameter portion 38 of barrel section 30 has shoulder 40 that will abut the firearm to which integral suppressor 5 is connected. The forward end 42 of spacer portion 38 defines a shoulder 44 and suppressor sleeve 20 will abut shoulder 44. An O-ring 45 will be placed in a groove 46 and will seal against inner surface 21 of outer sleeve 20. O-ring 45 and groove 46 are positioned forward of shoulder 44 or toward the end of barrel section 30, and thus toward the end of suppressor 5 through which the projectile exits. A port or vent 50 extends through non-fluted portion 36 of barrel section 20. Vent 50 communicates with a barrel opening 52 through which projectiles, or bullets pass when a firearm with suppressor 5 connected thereto is fired. Barrel opening 52 extends through barrel section 30. Circumferential slot 37 will allow rotation of a metering device the length of slot 37 as described in more detail herein. Rotation of the metering device will operate to open or close port 50 to allow or prevent communication of gas from barrel opening 52 to the outside of barrel section 30. This provides for a suppressor that is convertible between an integral suppressor with an open gas vent to a suppressor with a closed gas vent. Slot 37 has ends 56 and 58.

Figure 3:
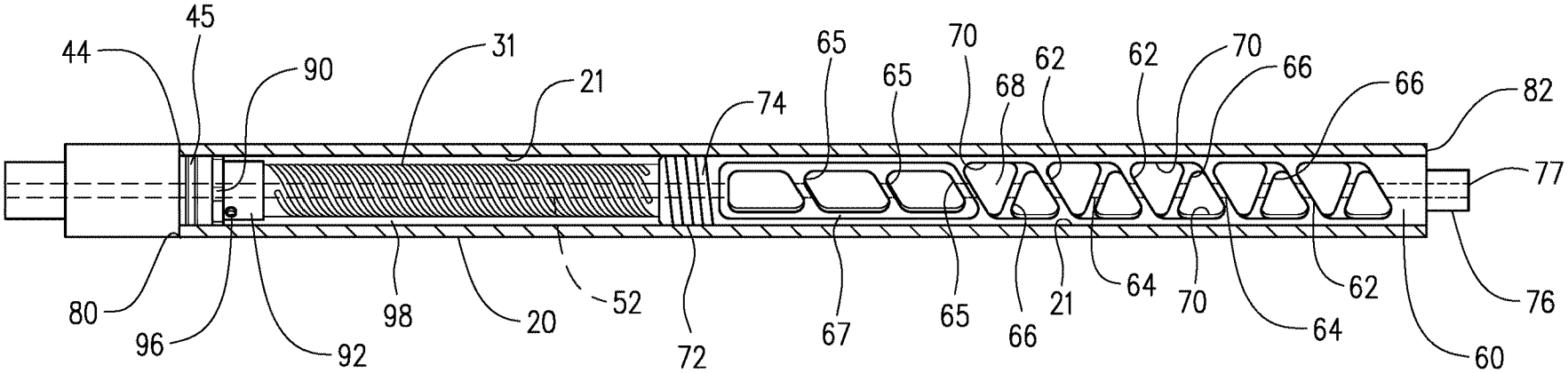
FIG. 3 is a cross section showing the barrel section and the baffle section of the integral suppressor without an end cap connected thereto.
Figure 4:
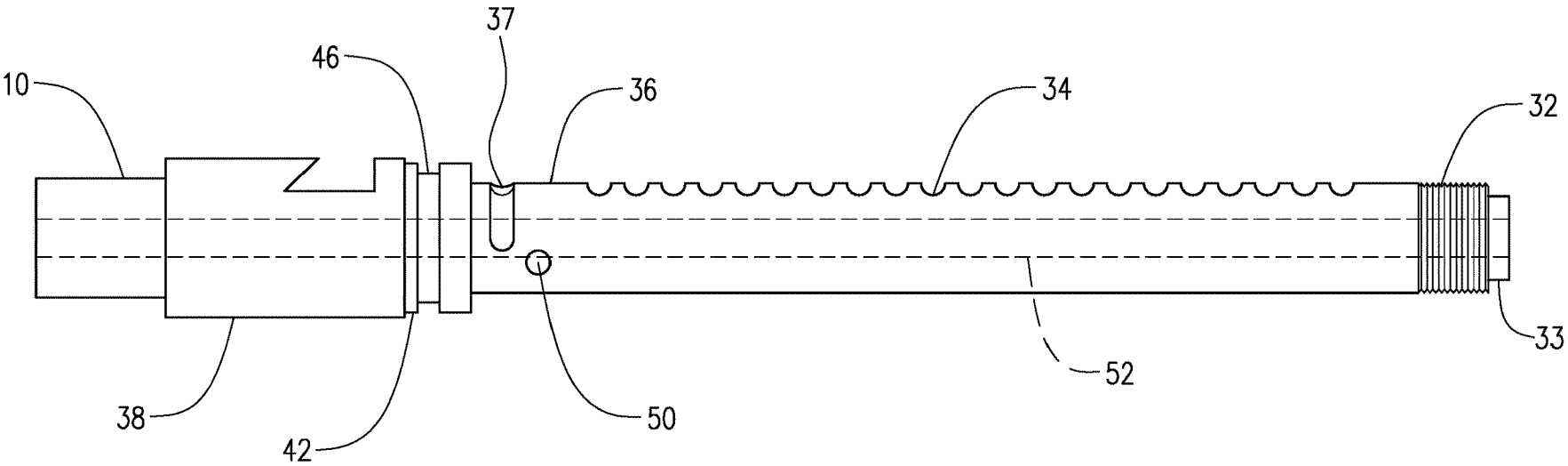
FIG. 4 is a view of the barrel section, with fluting represented by notches.
Figure 5:
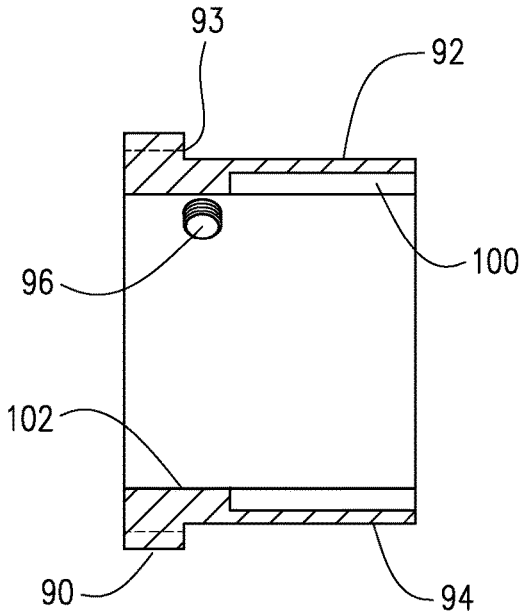
FIG. 5 is a section view of a metering device.
Figure 5:
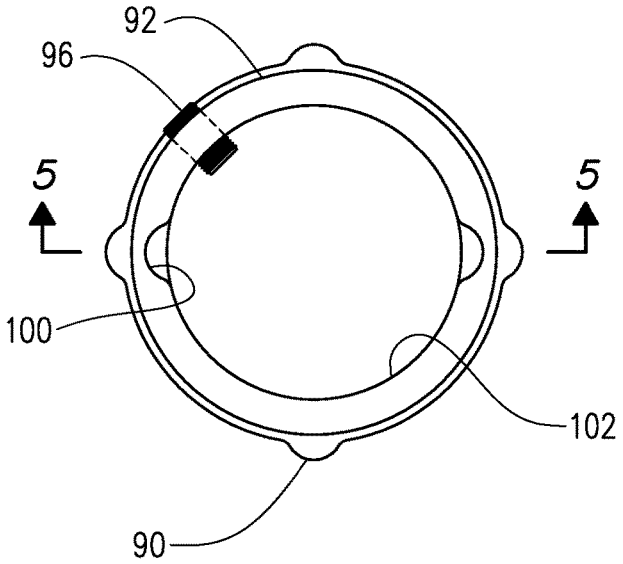
Figure 5:
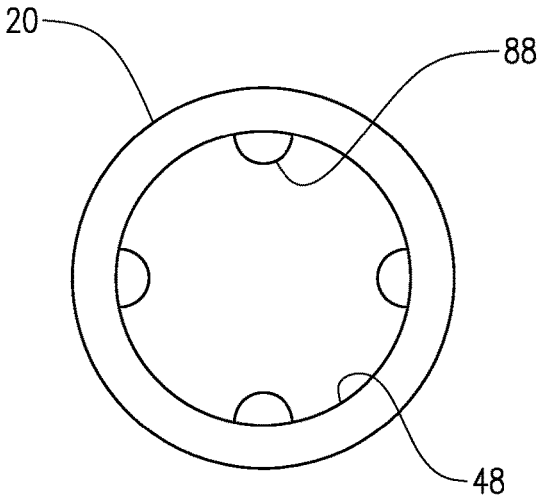
Figure 7:
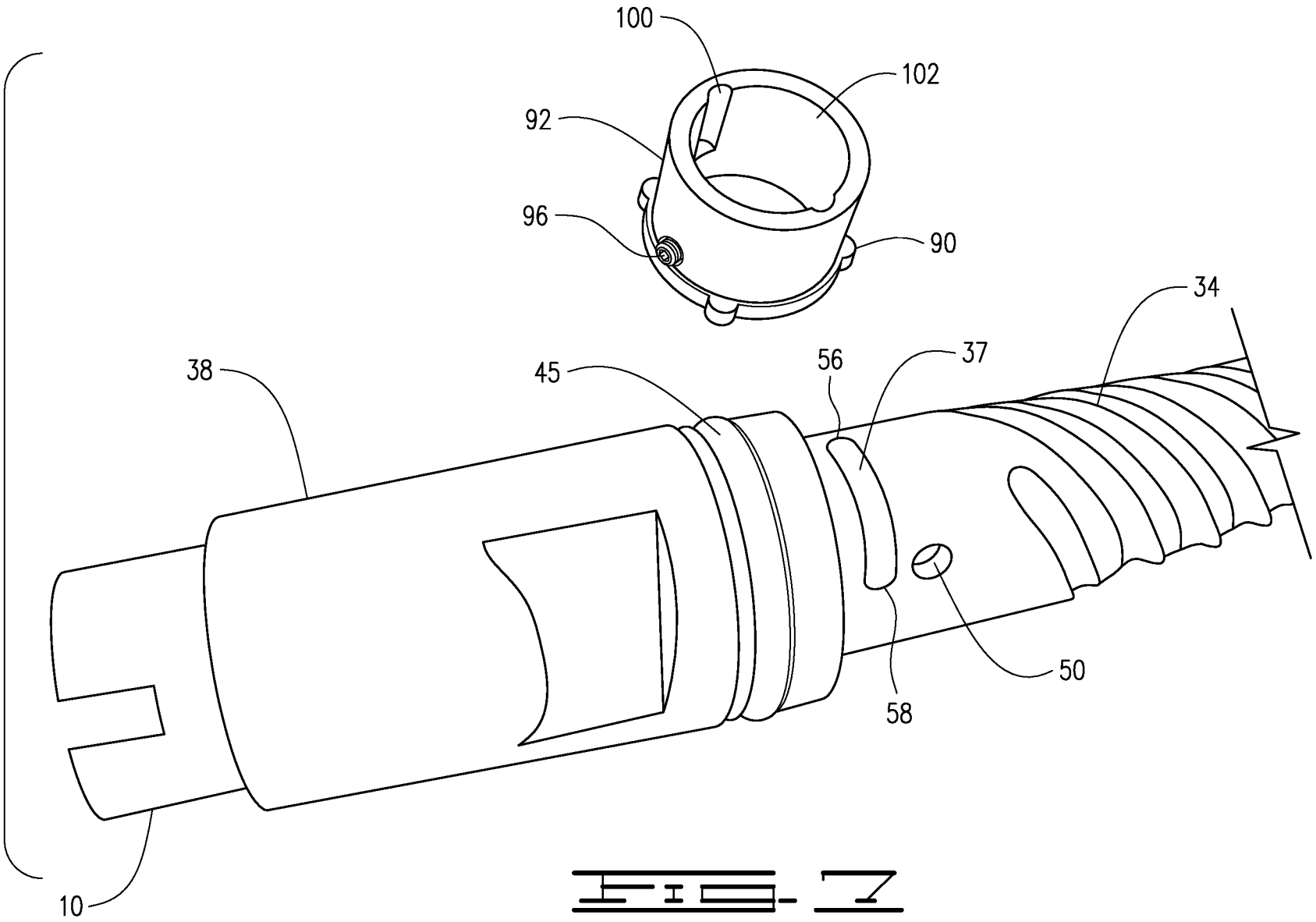
Figure 5:
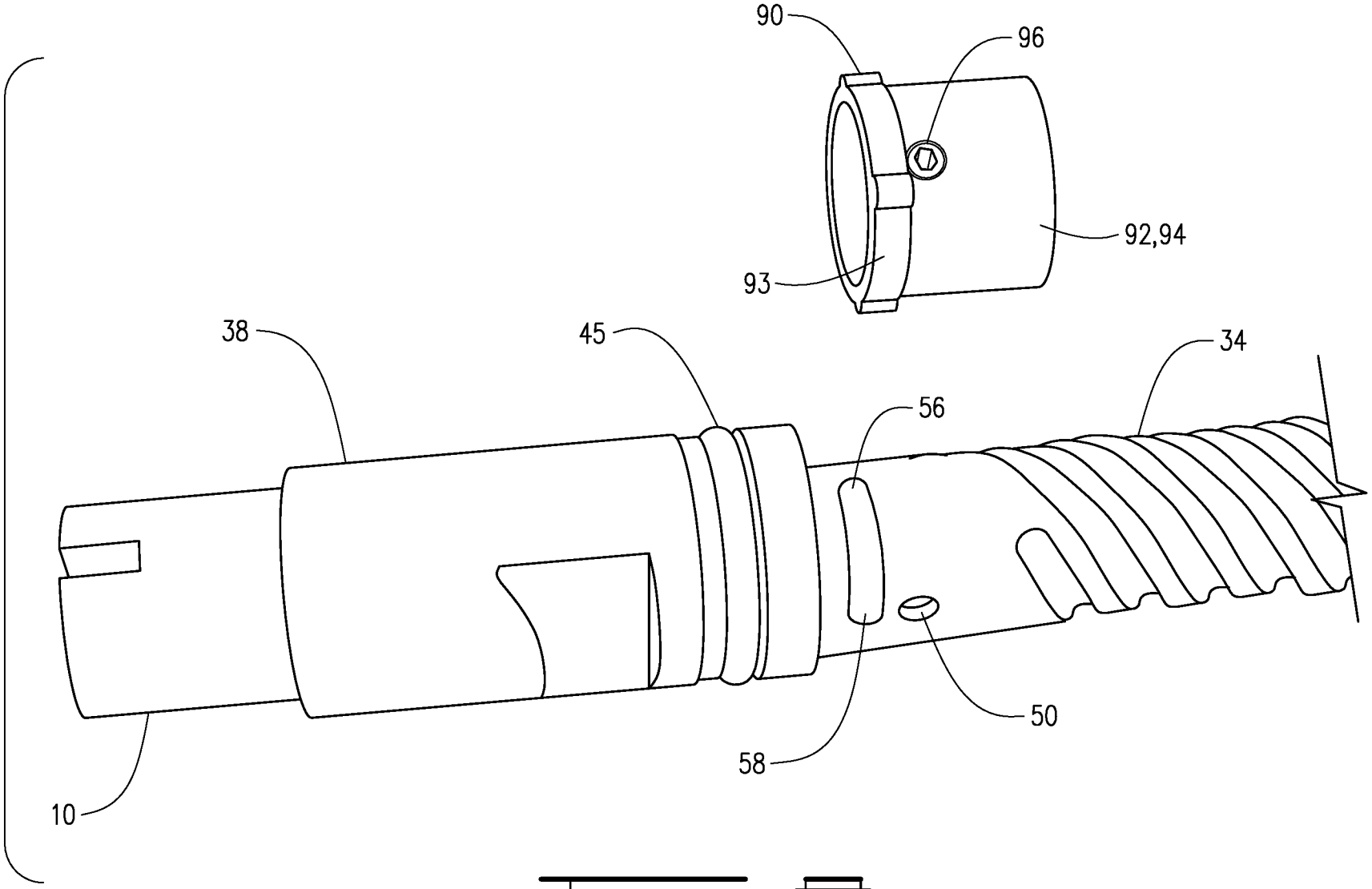

Referring now to FIG. 3, baffle section 60 is shown. In the embodiment described, baffle section 60 may be threadedly connected to barrel section 30. However, it is understood that baffle section 60 and barrel section 30 may be integrally formed or manufactured. Baffle section 60 includes a plurality of primary baffles 62 with barrel hole openings 64 therethrough. It is understood that a projectile exiting barrel opening 54 will fire through openings 64. The rearmost portion of baffle section 60 includes three rear baffles 65 which may comprise a steel insert that is removable and replaceable. Alternatively, the entire baffle section 60 may be integrally formed with an aluminum or other suitable material. All of primary baffles 62 are generally parallel. Baffles 65 are also parallel to primary baffles 62. In a typical baffle suppressor, each of the baffles will be generally parallel. However, the current embodiment discloses intermediate baffles 66 as well, which as shown in FIG. 3 bisect the generally parallelogram shaped openings 68 defined by primary baffles 62 into two triangular shaped openings 70. Intermediate baffles 66 do not engage the suppressor sleeve 20, so that there is a space between the inner surface 21 of suppressor sleeve 20 and baffles 66. Intermediate baffles 66 are parallel to each other, but are not parallel to baffles 62, which may be referred to as primary baffles 62. Barrel section 20 and baffle section 30 may be collectively referred to as an internal suppressor assembly.

A rear or aft end 72 of baffle section 60 has a helical groove 74 therein which will allow gas to pass therethrough when ammunition is fired. Baffle section 60 has a threaded end 76 to which end cap 25 will be connected. An exit opening 77 is defined through threaded section 76, and projectiles fired through suppressor 5 will pass therethrough. Outer sleeve 20 is a generally cylindrical sleeve with a rear or aft end 80 and a forward end 82. Aft end 80 will abut shoulder 44 and will be sealingly engaged with the O-ring 45 disposed in groove 46. Inner surface 21 of suppressor sleeve 20 will have lobes 88 thereon which will mate with lobes 90 on a metering device 92. Metering device 92 may also be referred to as a cam 92 and is rotatable by rotating sleeve 20. Metering device 92 is a generally cylindrical sleeve 94 with an outwardly extending shoulder 93. Lobes 90 are positioned on shoulder 93. A set screw 96 will extend through metering device 92 and will be received in peripheral slot 37. An annular space 98 is defined by and between diameter 39 defined by barrel section 30 and inner surface 21 of suppressor sleeve 20.

When suppressor sleeve 20 abuts shoulder 44 and end cap 25 is tightened firearm suppressor 5 may be fired through. Metering device 92 may be rotated to cover vent 50 as shown in FIG. 12 prior to firing. When vent 50 is covered gas will pass out of the end 33 of barrel section 30 and will be communicated into helical groove 74 at the rear end of baffle section 60 and will be communicated through helical groove 74 into annular space 98. Thus, the release of gas through exit end 82 is delayed. In addition, intermediate baffles 66 are shaped to have a width less than an inner diameter of the suppressor sleeve 20 and as such will create a space therebetween. Eddies or swirls will be created between suppressor sleeve 20 and baffles 66 which will further delay the release of gas through exit end 82 and create additional suppression.

When integral suppressor 5 is used in this manner effective sound suppression, or decibel reduction is achieved with little or no velocity loss. If desired, integral suppressor 5 may be converted to a suppressor with an open vent simply by loosening end cap 25 and rotating outer sleeve 20. The engagement of lobes 88 on suppressor sleeve 20 with lobes 90 on metering device 92 cause rotation of metering device 92. Rotation is limited to the length of peripheral slot 37. Thus, the degree of rotation is limited by ends 56 and 58. Set screw 96 will engage one of ends 56 and 58 of peripheral slot 37 to stop rotation. In this way, the user can determine when the metering device is properly positioned. The vent 50 and peripheral slot 37 may be positioned such that when set screw 96 engages end 58, the vent is closed, and when end 56 is engaged, the vent 50 is open. As will be understood, the reverse is also easily accomplished by simply rearranging the location of the vent 50. When metering device 92 is positioned as desired, end cap 25 is tightened. When metering device 92 is in the open position, longitudinal slots 100 in the inner surface 102 thereof will be in communication with vent 50.

Figure 11:
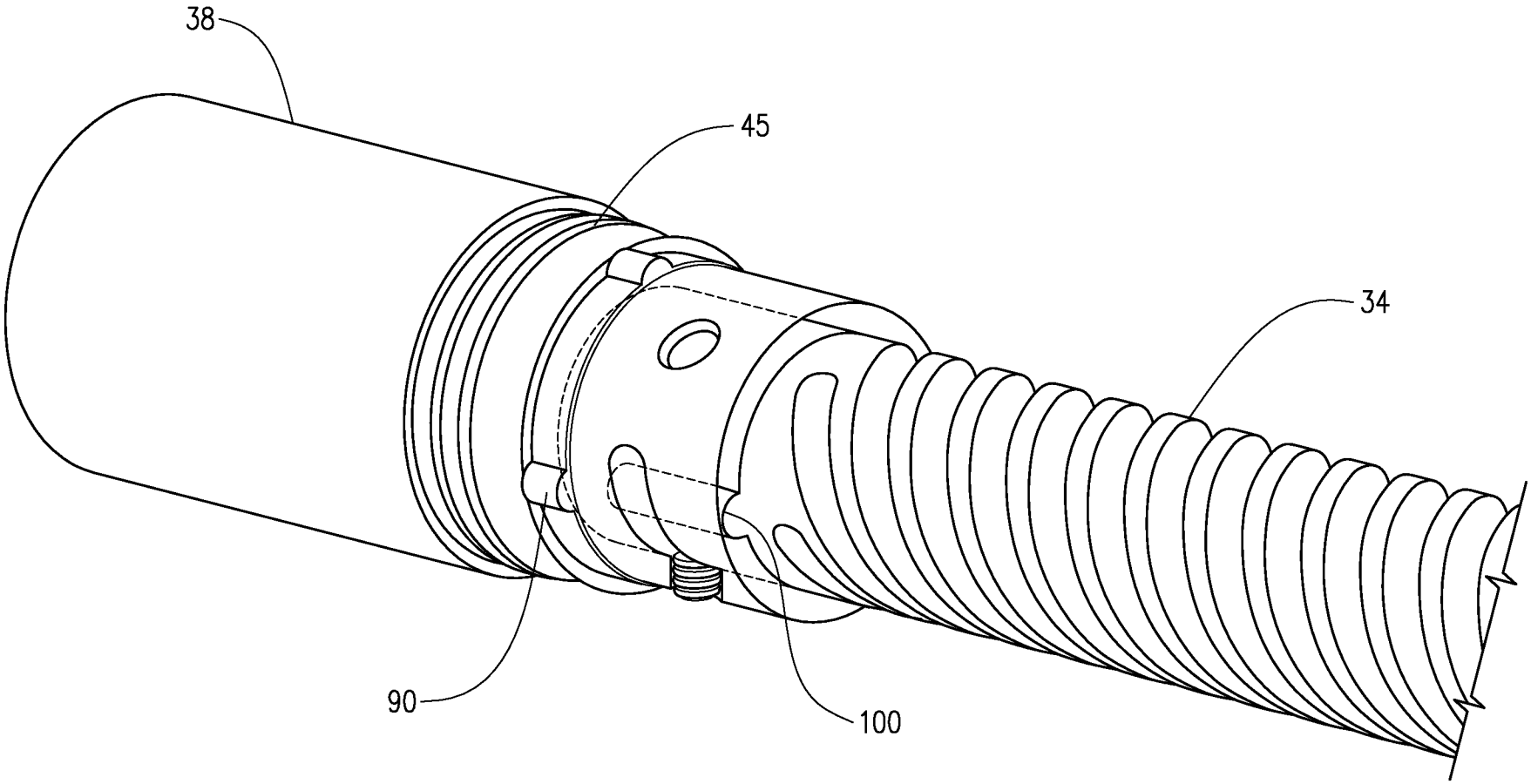
FIG. 11 shows an arrangement with the metering device rotated so that the vent port is not communicated with slots in the metering device.

FIG. 11 shows an arrangement in which the metering device is rotated so that set screw 96 engages end 58 of slot 37, and none of communication grooves or slots 100 in metering device 92 will communicate with vent 50. This is the closed position of the suppressor 5, and metering device 92. As such, upon firing little or no gas will escape vent 50 through the longitudinal grooves 100. Gas from barrel opening 54 will pass into baffle section 60, and will be communicated into annulus 98 through helical groove 74. Maximum velocity is achieved, and sound suppression is likewise achieved.

Figure 10:
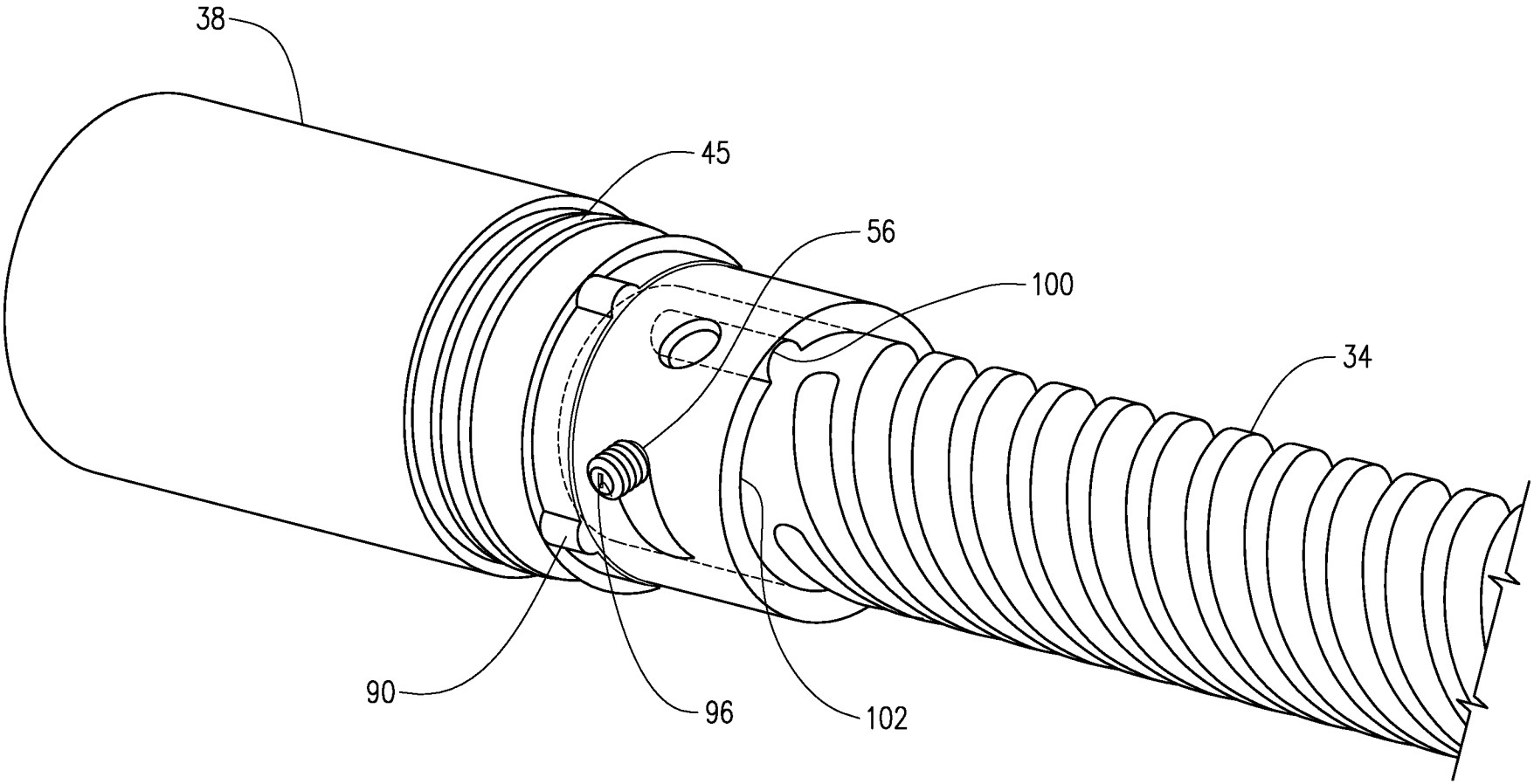
FIG. 10 shows an arrangement with the metering device rotated so that the vent port is communicated with slots in the metering device.

FIG. 10 shows an arrangement in which metering device 92 is rotated so that set screw 96 engages end 56 of slot 37, and communication grooves 100 in metering device 92 communicate with vent 50. In the open position of the metering device, vent 50 is open. As such, upon firing gas will escape into vent 50 from barrel opening 52, and pass through a longitudinal groove 100 and will pass into annular space 98. This will cause a decreased projectile velocity, but will also increase sound suppression with most ammunition over that when the vent 50 is closed. Thus, the user can essentially tune the suppressor to achieve different results relating to muzzle velocity and decibel reduction. If desired, different vents of varying diameters may be utilized to allow even finer tuning of the suppressor.

Thus, the current disclosure describes a convertible suppressor with an openable and closeable vent which may be opened and closed with no disassembly and without the use of any tools. When the metering device 92 is positioned to close the port, little or no gas is lost through the ports so velocity is not lost. In the closed state there is still sound suppression and the integral suppressor acts similarly to a reflex suppressor. If additional suppression is required or desired, the end cap 25 may simply be loosened, suppressor sleeve 20 rotated to the position in which the vent 50 is open and gas may be communicated therethrough. In this manner, the suppressor is converted to a suppressor that reacts more similarly to a standard integral suppressor in which gas exits the port and moves into the annular space 98 between the suppressor sleeve 20 and barrel section 30.

The firearm suppressor 5 provides a user with versatility and the ability to use ammunition of different types without the need for disassembly to achieve desired suppression. If maximum suppression is desired, for example with supersonic ammunition, and velocity loss is not a concern, the suppressor 5 can be used in the open position If subsonic ammunition is in use, and suppression is desired with little to no velocity loss the suppressor 5 may be used in the closed position. The user can thus achieve different results with the suppressor, simply by moving from open to closed or closed to open positions.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A firearm suppressor comprising:

a barrel section defining a vent therethrough; and a baffle section extending from the barrel section;

a suppressor sleeve disposed about the barrel section and the baffle section, the baffle section comprising;

an outer member extending forward from an end of the barrel section to an end of the suppressor sleeve;

a plurality of baffles integrally formed with the outer member;

a removable and replaceable baffle insert defining a plurality of baffles positioned in the outer member rearward of the integrally formed baffles.

2. The firearm suppressor of claim 1, the insert comprising a steel insert.

3. The firearm suppressor of claim 1, further comprising a removable end cap configured to hold the suppressor sleeve in place.

4. The firearm suppressor of claim 1, the baffle section configured to communicate gas into an annulus defined by the barrel section and the suppressor sleeve when a projectile is fired therethrough.

* * * * *